US006050906A

United States Patent [19]

Stout et al.

[11] Patent Number: 6,050,906

[45] Date of Patent: Apr. 18, 2000

[54] MECHANICAL FOOTBALL CENTERING DEVICE

[76] Inventors: Ryan L. Stout, 1956 Chorro St., San Luis Obispo, Calif. 93401; Christopher A. Stout, 2223 Corte Melina, Pleasanton, Calif. 94566; Robert M. Fresques, 2932 Weald Way #1611, Sacramento, Calif. 95833

[21] Appl. No.: 09/037,779

[22] Filed: Mar. 10, 1998

Related U.S. Application Data

[60] Provisional application No. 60/046,192, May 12, 1997.

[51] Int. Cl.[7] ..... A63B 67/00

[52] U.S. Cl. ..... 473/438

[58] Field of Search ..... 473/438

[56] References Cited

U.S. PATENT DOCUMENTS

| | | | |
|---|---|---|---|
| 2,080,958 | 5/1937 | Beasley et al. . | |
| 2,767,985 | 10/1956 | Maxcey, Jr. | 473/438 |
| 3,044,776 | 7/1962 | Weidmaier | 473/438 |
| 3,399,892 | 9/1968 | Jurkiewicz | 473/438 |
| 3,467,380 | 9/1969 | Bonacci | 473/438 |
| 3,700,238 | 10/1972 | Mathis | 473/438 |
| 3,951,125 | 4/1976 | Dixon . | |
| 4,261,319 | 4/1981 | Dixon . | |
| 4,906,001 | 3/1990 | Vaughn . | |

*Primary Examiner*—Theatrice Brown
*Attorney, Agent, or Firm*—Richard C. Litman

[57] ABSTRACT

A mechanical football centering device for training quarterbacks to receive a snapped football. The device includes a magnetic latch which is releasable by a motion closely simulating the signal which a quarterback gives to a human center, and includes features which allow the quarterback to adjust the football's orientation and to practice "riding the center."

14 Claims, 2 Drawing Sheets

MECHANICAL FOOTBALL CENTERING DEVICE

CROSS-REFERENCE TO RELATED APPLICATION

This application claims the benefit of U.S. Provisional Patent Application Serial No. 60/046,192, filed May 12, 1997.

BACKGROUND OF THE INVENTION

1. Field of the Invention

The present invention generally relates to athletic training equipment. More particularly, it relates to a football centering device that delivers a football into the hands of a quarterback in a manner that very closely simulates the delivery by a human center.

2. Description of Related Art

A football offensive line coach will often desire to drill the offensive line at the same time the quarterback coach desires to drill the quarterback. As a result, the linemen often must practice plays without the presence of the center. Similarly, the quarterback must often wait for the linemen to finish their drills before he can commence with his practice.

For these and other reasons, inventors have developed a number of mechanical devices intended to deliver a football to a quarterback. For example, a hiking mechanism is shown in the following U.S. Pat. Nos.: 3,044,776 issued to Weidmaier et al.; 3,467,380 issued to Bonacci; 2,767,985 issued to Maxcey, Jr. et al; 3,399,892 issued to Jurkiewicz; and 4,906,001 issued to Vaughn. U.S. Pat. No. 3,700,238, issued to Mathis, is not directed towards developing the quarterback's communication with the center, but rather, is directed towards developing a quarterbacks timing subsequent to the snap. Other patents which show football training equipment but which do not show football centering devices are U.S. Pat. Nos.: 3,951,125 and 4,261,319 issued to Dixon; 2,940,757 issued to Britt and 2,521,649 issued to Paupa.

All mechanical football centering devices include a pivotable football delivery arm which simulates a center snapping a football upward from the ground into the hands of a quarterback. The delivery arm is biased toward the upwardly rotated snapped position. A latch holds the delivery arm downwardly, in opposition to the biasing means. A trigger, activatable by the quarterback, releases the delivery arm latch and allows the biasing means to swing the delivery arm upward, thereby snapping the football into quarterback's hands.

Existing mechanical football centering devices vary widely in usefulness. The usefulness depends on how closely the mechanical centering device replicates the actions and response of a human center. For example, quarterbacks signal the center to snap the ball by nudging the center's inner thigh or buttocks with the back of his hand. It follows that mechanical centering devices which include a trigger activatable by the back of the quarterback's hand are more useful than those centering devices which use foot-activated triggers. While the mechanical-football-centering art is developing, all existing devices suffer several deficiencies.

The first deficiency relates to the latch mechanism. Existing centering devices all use mechanical latches. Mechanical latches are problematic for several reasons. They can bind. They require an excessive amount of force to overcome the static friction. They can also require exaggerated displacement in order to release the latch. These qualities inherent in mechanical latches require the quarterback to practice signalling the center by activating the trigger in an exaggerated manner which does not realistically replicate the subtle nudge which the quarterback typically uses to signal a human center. If a quarterback practices triggering a mechanical latch too often he can develop unnatural signalling habits which can prove uncomfortable to a human center.

The second deficiency relates to the trigger mechanism. As previously noted, the better triggers simulate the buttocks of a center. It is preferable if the trigger replicates the movement of the center subsequent to the snap. Simulation of such motion is desired because it allows the quarterback to practice staying in contact with the center until the ball is delivered, which is referred to as "riding the center." The existing devices do not teach triggers designed to allow the quarterback to practice riding the center.

The third deficiency relates to the football holding mechanism. Most inventions disclose holding mechanisms which delivers the football to the quarterback in a longitudinal orientation, and at least one invention discloses a holding mechanism which delivers the football in a sideways orientation. But none of the existing devices disclose a holding mechanism capable of delivering the football at any angular orientation chosen by the quarterback. Also, none of the existing devices disclose a holding mechanism which can be repositioned for use by either right-handed or left-landed quarterbacks.

The fourth deficiency relates to the mobility of existing centering devices. It is preferable that the device be immobile when positioned for use. Thus, mechanical football centering training devices tend to be rather heavy and difficult to transport. Some existing devices attempt to improve portability by disposing upon the frame at least one wheel in rotatable engagement with the ground to enable easy wheelbarrow-style transport. However, inclusion of a wheel defeats the goal of providing a device which is immobile while in use. Thus, all presently available devices compromise between immobility and transportability.

Although the art is slightly developed, a need still remains for a device that is mechanically simple, and yet not limited by any of the foregoing deficiencies. None of the above inventions and patents, taken either singly or in combination, is seen to describe the instant invention as claimed.

SUMMARY OF THE INVENTION

The present invention delivers a football to a quarterback in a manner that closely simulates the centering action of a human center. A football is held in a holding cup at the free proximal end of a pivoted delivery arm. The upwardly biased delivery arm is held in a downward position by a magnetic latch. The quarterback positions his hands under a padded trigger which is disposed above the proximal end of the delivery arm. Once positioned, the quarterback activates the trigger with a subtle upward nudge of the back of his hand in a manner simulating the signalling of the center. Activation of the trigger transmits an upward force to the delivery arm via an interconnecting adjustable snap strap. The upward force pulls the delivery arm out of magnetic contact with the base, disengaging the magnetic latch. Upon disengagement, the upwardly biased delivery arm rotates to thrust the ball into the quarterback's hands with substantially the same speed and force as would a human center.

The magnetic latch generally comprises two components, a magnet and a magnetically attractive material such as iron or a second magnet. One of the two components is disposed upon the delivery arm. The other component is disposed upon the base in rotational alignment with the first member.

A magnetic latch is used in place of traditional mechanical latches because magnets exert forces according to Coulomb's Law. Coulomb's law states that the force between two magnetic poles is proportional to the quotient of the product of the strengths of the poles (i.e. by attraction via opposite poles or by repulsion via similar poles) divided by the square of the distance between them. Because the Coulombic force of attraction between two dissimilar poles decreases as the distance between the poles increases, it follows that a relatively small displacement of the trigger arm will disengage the biased delivery arm from the magnetic latch. This is preferable because the quarterback does not have to exert upon the trigger that unnatural linear force which is required to displace a mechanical latch.

The mechanical football center also includes a means for downwardly biasing the trigger arm and a trigger arm travel limiter. The biasing means causes the trigger pad to exert a downward force upon the quarterback's hand. In combination, these features more accurately simulate the motion of a center subsequent to the snap of the football, and thereby allow the quarterback to practice riding the center.

Also, the football holding cup is pivotally connected to the delivery arm for adjustable positioning. This feature enables a quarterback to rotate the holding cup an entire 360° to deliver the football at any desired orientation. It also allows use of the device interchangeably by both right-handed and left-handed quarterbacks. Further, the holding cup pivot hole can be extended to form a pivot slot. This would give the quarterback even greater football positioning control by permitting proximal adjustment of the football's point of delivery or lateral adjustment for an off-center point of delivery.

Finally, the frame possesses at least one wheel extending outward and angled slightly upward. By being so angled, the wheel is not in rotatable engagement with the ground, and the device maintains its immobility while positioned for use. Upon upward rotation of the opposite end of the base, the wheel will engage the ground to enable easy trundle-style wheelbarrow transport with the major portion of the weight thereof supported upon the wheel. Preferably, the wheel should be disposed at the distal end of the base so as to not interfere with the intended use of the device. Also, a handle can also be included on the base opposite the wheel for even easier transport.

Accordingly, it is a principal object of the invention to provide a latch which is responsive to a motion which replicates the subtle nudge which the quarterback uses to signal a human center.

It is another object of the invention to provide a trigger which replicates the movement of the center subsequent to the snap so that the quarterback can practice "riding the center."

It is a further object of the invention to provide an adjustably rotatable football-holding mechanism capable of delivering the football to the quarterback at any chosen angular orientation.

It is a further object of the invention to provide an adjustably slidable football-holding mechanism capable of delivering the football to the quarterback at a variety of proximal and lateral positions relative to the trigger pad.

Still another object of the invention is to provide a football-holding mechanism which can be repositioned for use by either right-handed or left-landed quarterbacks.

Still another object of the invention is to provide a mechanical football center which is easily transportable, but will also remain immobile while in use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
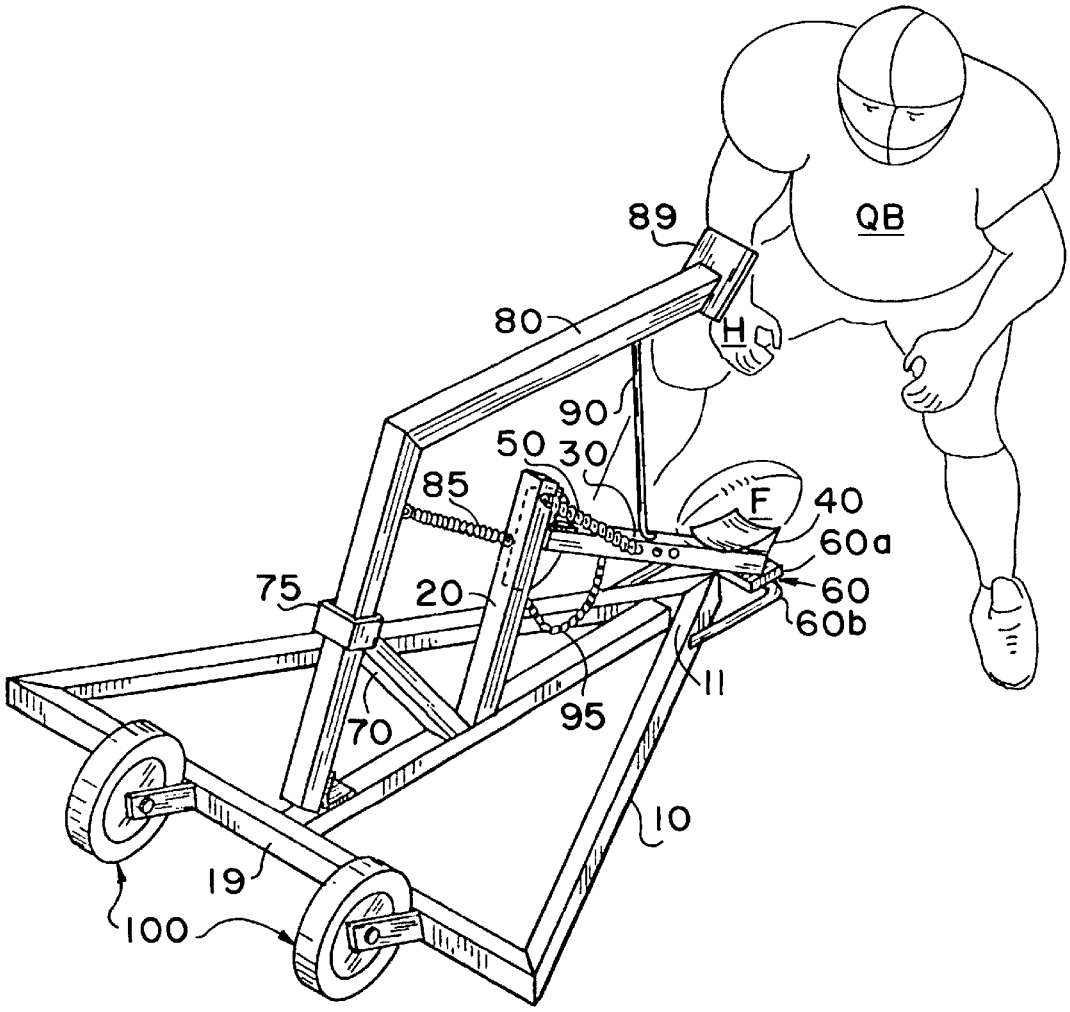
FIG. 1 is an environmental perspective view of the invention in its latched position.
Figure 2:
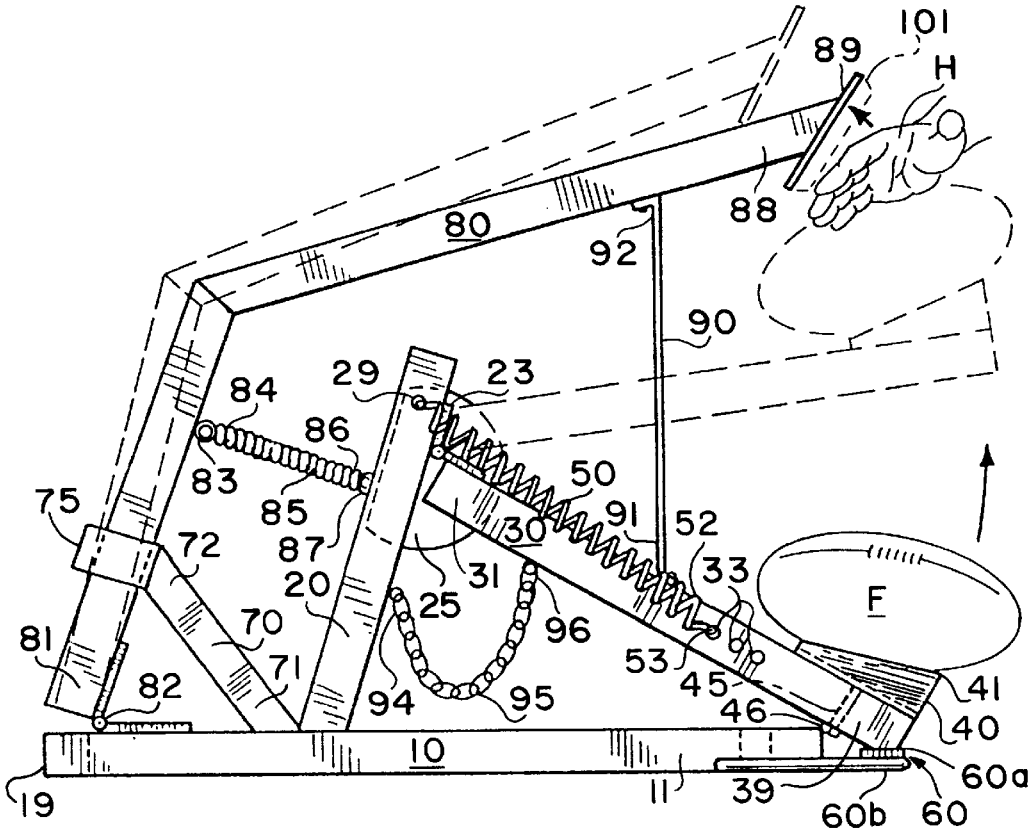
FIG. 2 is a side view of the invention in its latched position, depicting the snapped position in phantom lines.

The present invention is an improved mechanical football center training device which utilizes a magnetic latch. Referring to FIGS. 1 and 2, the disclosed device comprises a base 10 having a proximate end 11 and a distal end 19. A delivery arm support 20 is disposed upon the base.

A delivery arm 30 has a pivot end 31 pivotally connected to the delivery arm support 20 by means of conventional delivery arm support hinge 23. Delivery arm 30 also has a delivery end 39 extending proximally. A football holding cup 40 is pivotally disposed upon delivery end 39. Football holding cup 40 has an upper surface 41 designed to hold a football F. Football holding cup 40 is disposed upon the delivery end 39 for full 360° adjustable rotation by means of conventional bolt 45 and wing nut 46.

Delivery arm 30 is biased upwardly by delivery arm bias spring 50. Delivery arm bias spring 50 has a first end 51 which is connected to a delivery arm support pin 29 which is disposed upon delivery arm support 20, upward of the delivery arm support hinge 23. Delivery arm bias spring 50 has a second end 52 which is connected to delivery arm pin 53. Delivery arm 30 possesses therethrough a plurality of longitudinally-spaced tension-adjusting pin holes 33, sized to receive delivery arm pin 53 for adjusting the upward force which delivery arm bias spring 50 exerts upon delivery arm 30. Optional guide plate 25 depends from delivery arm support 20 adjacent the pivot end 31 of delivery arm 30 and guides the vertical rotation of delivery arm 30 and protects delivery arm support hinge 23 from damage.

A magnetic latch 60 comprises a first component **60*a* disposed at the delivery end 39 of delivery arm 30 and a second component 60*b* disposed at the proximal end 11 of base 10 in rotational alignment with first component 60*a*. The magnetic latch 60 holds delivery arm 30 downward in a latched position against the opposing upward force of delivery arm bias spring 50. One of the two latch components 60*a* and 60*b* is a magnet, and the other of the two latch components 60*a* and 60*b*** is a magnetically attractive material.

A trigger arm travel limiter comprises a trigger arm guide support 70 and a trigger arm guide collar 75. The trigger arm guide support 70 has a lower end 71 disposed upon base 10 distal of delivery arm support 20 and an upper end 72. The trigger arm guide collar 75 is disposed at upper end 72 of trigger arm guide support 70, and is sized to receive trigger arm 80 for limited rotation therein. Trigger arm 80 has a pivot end 81 pivotally connected to the base 10 by means of conventional trigger arm hinge 82. Trigger arm 80 also has a trigger end 88 disposed generally above and for spaced limited rotation relative to delivery arm 30. Hand trigger 89 is angularly disposed at trigger end 88 of trigger arm 80 for activation by the back of a hand H of quarterback QB. The hand trigger is preferably padded by a cushion 101 at the point of contact by the hand of the quarterback.

A trigger arm biasing spring 85 has a first end 84 attached to trigger arm 80 by means of conventional eye-bolt 83 and a second end 86 attached to delivery arm support 20 by means of conventional eye-bolt 87. The trigger arm biasing spring 85 biases trigger arm 80 downward until stopped by trigger arm travel limiter 75.

Adjustable snap strap 90 has a lower end 91 connected to delivery arm 30 and an upper end 92 connected to trigger arm 80. Activation of padded hand trigger 89 by back of hand H rotates trigger arm 80 upward about trigger hinge 82. The upward movement of trigger end 88 transmits an upward force upon delivery arm 30 via snap strap 90, thereby displacing delivery end 39 sufficiently to disengage magnetic latch 60. Disengagement of magnetic latch 60 permits delivery arm bias spring 50 to rotate delivery arm upward into a snapped position, thrusting football F into hand H of quarterback QB. An adjustable chain 95 has a first end 94 connected to delivery arm support 30 below pivot end 31 of delivery arm 30 and having a second end 96 connected to delivery arm 30 for adjustably limiting the upward rotation of delivery arm 30.

Referring to FIG. 1, the device is readily moved between storage and usage locations. A pair of wheels 100 are disposed angularly above and distal to the distal end of base 10 so that wheels 100 are not in rotatable engagement with the ground when the device is positioned for use. Second latch component 60*b*, disposed at proximal end 11 of base 10, is formed in the shape of a graspable handle. When handle 60*b* is lifted, base 10 pivots upward off of the ground and wheels 100 rotate downward into rotatable engagement with the ground. The device can thereby be trundled like a wheelbarrow with the major portion of the weight thereof supported upon the wheels 100. For weight and strength considerations, the base, the delivery arm support, and the trigger arm travel limiter are constructed of steel, and the trigger arm and the delivery arm is constructed of aluminum.

It is to be understood that the present invention is not limited to the sole embodiment described above, but encompasses any and all embodiments within the scope of the following claims.

We claim:

1. A mechanical football centering device, comprising:

a base having a proximate end and a distal end;

a delivery arm support disposed upon the base;

a delivery arm having a pivot end pivotally connected to the delivery arm support and a delivery end, the delivery arm being pivotable between a latched position in which the delivery end is positioned downwardly for magnetic latching to the base, and a snapped position in which the delivery end is rotated upward;

a cup for holding a ball disposed upon the delivery end;

a delivery arm biasing means for urging the delivery arm towards the snapped position;

a magnetic latch for holding the delivery arm in the latched position against the force of the delivery arm biasing means;

a trigger arm having a hinged end and a trigger end, the hinged end being pivotally connected to the base and spaced from the delivery arm support, and the trigger end being disposed above and for limited rotation relative to the delivery arm;

a hand trigger angularly disposed at the trigger end of the trigger arm for activation by the back of a quarterback's hand; and a flexible strap strap having an upper end attached to the trigger arm and a lower end attached to the ball delivery arm, whereby upward rotation of the trigger arm will transmit a force via the snap strap disengaging the magnetic latch and permitting the delivery arm biasing means to rotate the delivery arm into the snapped position.

2. The mechanical football centering device according to claim 1, further comprising a delivery arm rotation limiter for limiting the rotation of the delivery arm in the direction of the snapped position.

3. The mechanical football centering device according to claim 2, wherein the delivery arm rotation limiter comprises a chain having an adjustable length, the chain having a first end connected to the delivery arm support and a second end connected to the delivery arm.

4. The mechanical football centering device according to claim 1, further comprising a trigger arm travel limiter for limiting the range of rotation of the trigger arm.

5. The mechanical football centering device according to claim 4, wherein the trigger arm travel limiter comprises:

an elongated trigger arm guide support having first and second ends, said first end being secured to said base adjacent said delivery arm support and said second end having a trigger arm guide collar slidably attached thereto, said guide collar extending around said trigger arm support for limiting pivotal movement of said trigger arm about said hinge end.

6. The mechanical football centering device according to claim 1, wherein:

the magnetic latch comprises a first and second component, the first component attached to said proximate end of the delivery arm and the second component being attached to said base for engagement with the first component; and wherein one of said first and second components is a magnet, and the other of said first and second components is a magnetically attractive material.

7. The mechanical football centering device according to claim 1, wherein the delivery arm biasing means comprises a spring having a first end and a second end, the first end connected to the delivery arm support above the pivot end of delivery arm, and the second end connected to the delivery arm.

8. The mechanical football centering device according to claim 1, wherein the delivery arm biasing means is adjustable.

9. The mechanical football centering device according to claim 1, further comprising a trigger arm biasing means for biasing the trigger arm downwardly.

10. The mechanical football center device according to claim 9, wherein the trigger arm biasing means comprises a spring having a first end attached to the trigger arm and having a second end attached to the delivery arm support.

11. The mechanical football centering device according to claim 1, wherein the cup is pivotally and mounted on the delivery end.

12. The mechanical football centering device according to claim 1, wherein the base and the delivery arm support are constructed of steel, and the trigger arm and the delivery arm is constructed of aluminum.

13. The mechanical football centering device according to claim 1, further comprising:

a wheel supported angularly above and distal to the distal end of the base so that the wheel is not in rotatable engagement with the ground when the device is positioned for use; and a handle disposed at the proximate end of the base for pivoting the base upward onto the wheel whereby said device can be trundled with the major portion of the weight of the device supported by the wheel.

14. The mechanical football centering device according to claim 1, further comprising a cushion attached to said hand trigger.

* * * * *